US012618578B2

(12) United States Patent
Tatei

(10) Patent No.: US 12,618,578 B2
(45) Date of Patent: May 5, 2026

(54) AIR-CONDITIONING MANAGEMENT APPARATUS AND AIR-CONDITIONING MANAGEMENT SYSTEM

(71) Applicant: Mitsubishi Electric Corporation, Tokyo (JP)

(72) Inventor: Shuichi Tatei, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 412 days.

(21) Appl. No.: 18/556,399

(22) PCT Filed: Apr. 28, 2021

(86) PCT No.: PCT/JP2021/016997
§ 371 (c)(1),
(2) Date: Oct. 20, 2023

(87) PCT Pub. No.: WO2022/230114
PCT Pub. Date: Nov. 3, 2022

(65) Prior Publication Data

US 2024/0318849 A1 Sep. 26, 2024

(51) Int. Cl.
*F24F 11/49* (2018.01)
*F24F 11/63* (2018.01)

(52) U.S. Cl.
CPC ..... *F24F 11/49* (2018.01); *F24F 11/63* (2018.01)

(58) Field of Classification Search
None
See application file for complete search history.

(56) References Cited

U.S. PATENT DOCUMENTS

| | | | | |
|---|---|---|---|---|
| 11,112,785 | B2 * | 9/2021 | Cella | G05B 19/4185 |
| 12,169,075 | B2 * | 12/2024 | Cimberio | F24F 11/84 |
| 2015/0051741 | A1 * | 2/2015 | Bruck | F24F 11/63 700/276 |
| 2019/0242605 | A1 * | 8/2019 | Shekhar Nalajala | F24F 11/52 |
| 2020/0370772 | A1 * | 11/2020 | Inoue | F24F 11/65 |
| 2021/0207833 | A1 * | 7/2021 | Dameno | F24F 11/58 |

(Continued)

FOREIGN PATENT DOCUMENTS

| | | |
|---|---|---|
| JP | 2005-009692 A | 1/2005 |
| JP | 2005-180813 A | 7/2005 |
| JP | 2018-010421 A | 1/2018 |

OTHER PUBLICATIONS

M. Zaheer-uddin, G.R. Zheng, "Optimal control of time-scheduled heating, ventilating and air conditioning processes in buildings, Energy Conversion and Management", 2000, Energy Conversion and Management 41, pp. 49-60. (Year: 2000).*

(Continued)

*Primary Examiner* — Ariel Mercado-Vargas
(74) *Attorney, Agent, or Firm* — Posz Law Group, PLC

(57) ABSTRACT

The plurality of edge devices are distributed in a plurality of time zones. The network server includes a storage unit to store operation data, and a data collection control unit connected to a plurality of edge devices via a public communication line and configured to collect the operation data and store the collected operation data in the storage unit. The data collection control unit determines a time to collect the operation data from each of the plurality of edge devices based on a standard time of a time zone where each of the plurality of edge devices is disposed.

3 Claims, 6 Drawing Sheets

(56) References Cited

U.S. PATENT DOCUMENTS

| | | | | |
|---|---|---|---|---|
| 2022/0010996 | A1* | 1/2022 | Carrieri | F24F 8/108 |
| 2022/0307719 | A1* | 9/2022 | Boyd | F24F 11/65 |

OTHER PUBLICATIONS

International Search Report of the International Searching Authority mailed Jul. 20, 2021 for the corresponding International Application No. PCT/JP2021/016997 (and English translation).

* cited by examiner

AIR-CONDITIONING MANAGEMENT APPARATUS AND AIR-CONDITIONING MANAGEMENT SYSTEM

CROSS-REFERENCE TO RELATED APPLICATION

This application is a U.S. national stage application of International Application No. PCT/JP2021/016997 filed on Apr. 28, 2021, the contents of which are incorporated herein by reference.

TECHNICAL FIELD

The present disclosure relates to an air-conditioning management apparatus and an air-conditioning management system.

BACKGROUND

An air conditioner including at least one outdoor unit and an indoor unit can be operated by a control device such as a system controller to control an operation condition of the indoor unit.

Such a control device can also collect data related to the usage status of the air conditioner in order to maintain the performance of the air conditioner and prevent the failure of the air conditioner. Although the control device described above is disposed in a building or the like where the air conditioner is installed, there has been proposed a method of constructing an air-conditioning management system on a server (such as a cloud-based system) running on a network so as to control air conditioners installed at a remote location. For example, there has been proposed an air-conditioning management system equipped with a cloud-based system to control air conditioners installed in homes, buildings, factories, or other properties.

When an air-conditioning management system is running on a network, a communication load of the network or a processing load of the air-conditioning management system may become too large, which causes communication delays and transmission/reception failures that result in data loss, making it impossible to obtain useful management data.

As a technology to solve this problem, Japanese Patent Laying-Open No. 2005-180813 (PTL 1) discloses a data collection system that can accurately determine an average value of data even when the time interval for collecting data from an air conditioner changes.

PATENT LITERATURE

PTL 1: Japanese Patent Laying-Open No. 2005-180813

A cloud-based system has an upper limit on resources (such as the number of simultaneous executions) at the time of collecting data. On the other hand, an air-conditioning management system may be used to collect data from a large number of air conditioners disposed in multiple regions. Therefore, when a large number of data collections are performed simultaneously in the air-conditioning management system, the data collection may not be successfully performed due to the upper limit of resources. For example, in the air-conditioning management system, the number of simultaneous launches of data collection programs may be limited.

In the case of collecting data from a large number of targets, since the data collection process is centralized on the air-conditioning management system, it is necessary to prevent the processing load from exceeding the resources available in the air-conditioning management system. However, the data collection system disclosed in Japanese Patent Application Laying-Open No. 2005-180813 (PTL 1) cannot manage the processing load because the data collection system is configured to use an arithmetic method to improve the accuracy of data collection.

Further, the arithmetic method used by the data collection system cannot be applied to the collection of data other than numerical data such as operation start/stop information of the air conditioner, and the data collection cannot be successfully performed when data is missing due to communication errors or the like.

SUMMARY

The present disclosure has been made to solve the aforementioned problems, and it is therefore an object of the present disclosure to provide an air-conditioning management apparatus and an air-conditioning management system capable of successfully performing data collection while avoiding restrictions due to an upper limit of cloud resources by controlling a timing to collect data from an edge device when collecting data from a large number of targets.

The present disclosure relates to an air-conditioning management apparatus configured to collect operation data of an air conditioner via a public communication line and a plurality of edge devices. The plurality of edge devices are distributed in a plurality of time zones. The air-conditioning management apparatus includes a storage unit to store the operation data, and a data collection control unit connected to the plurality of edge devices via the public communication line and configured to collect the operation data and store the collected operation data in the storage unit. The data collection control unit determines a time to collect the operation data from each of the plurality of edge devices based on a standard time of a time zone where each of the plurality of edge devices is disposed.

According to the air-conditioning management apparatus and the air-conditioning management system of the present disclosure, by determining a time to collect the operation data based on a time zone where an edge device is installed, it is possible to distribute the load of the data collection on the cloud-based system, and it is possible to perform the data collection while avoiding restrictions due to an upper limit of resources.

DETAILED DESCRIPTION

Figure 1:
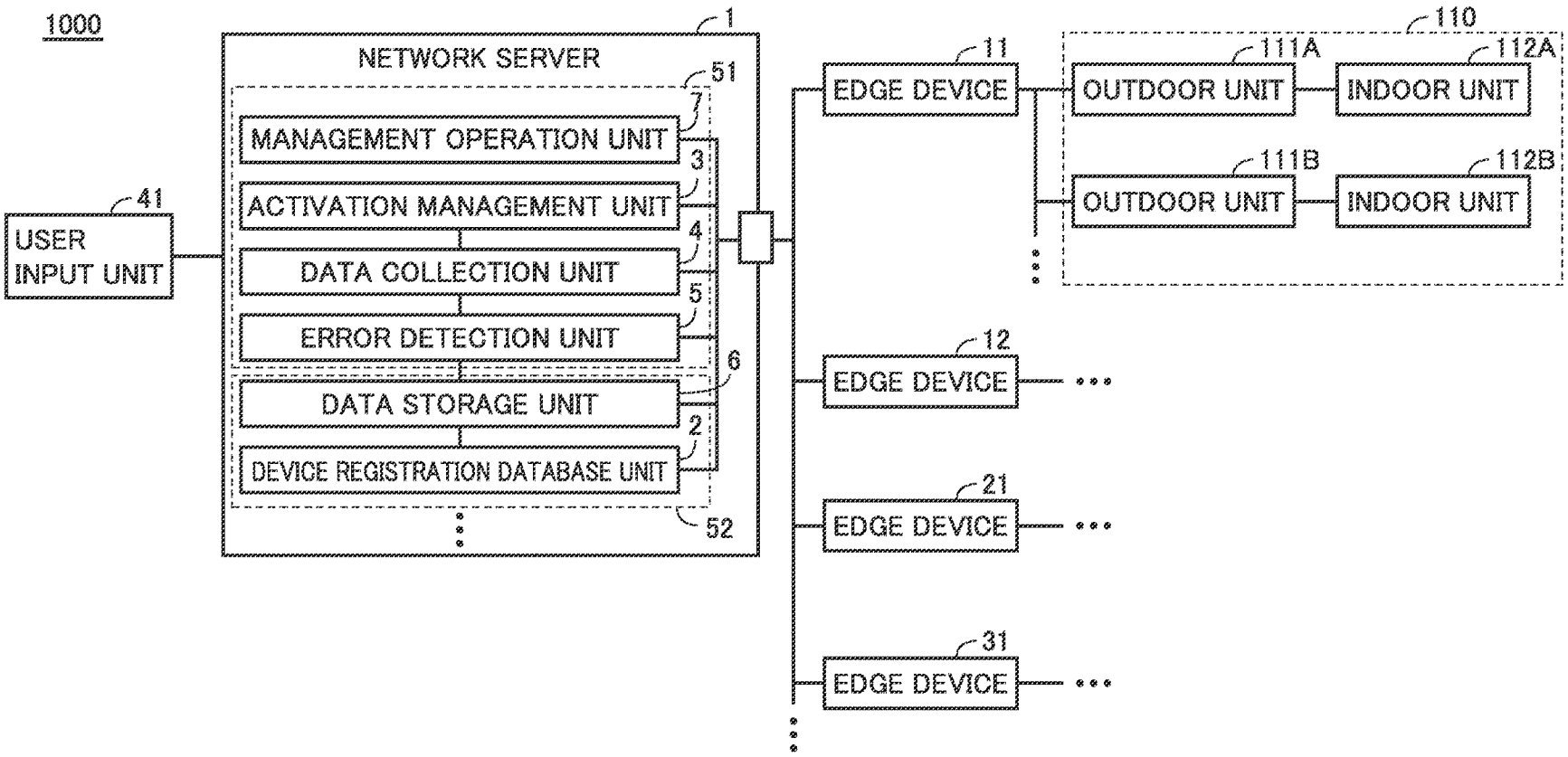
FIG. 1 is a block diagram illustrating a configuration of an air-conditioning management system according to a first embodiment.

Hereinafter, embodiments of the present disclosure will be described in detail with reference to the drawings. In the following description, a plurality of embodiments will be described, and appropriate combinations of components described in the respective embodiments are also originally intended. In the drawings, the same or corresponding parts are denoted by the same reference numerals, and the description thereof will not be repeated.

In the following drawings, the dimensions of each component may be different from the actual ones.

First Embodiment

FIG. 1 is a block diagram illustrating a configuration of an air-conditioning management system according to a first embodiment. As illustrated in FIG. 1, the air-conditioning management system 1000 according to the first embodiment includes a network server 1, an edge device 11, an edge device 12, an edge device 21, an edge device 31, an outdoor unit 111A, an indoor unit 112A, an outdoor unit 111B, an indoor unit 112B, and a user input unit 41.

The network server 1 includes a data collection control unit 51 and a storage unit 52. The data collection control unit 51 corresponds to a central processing unit (CPU), and the storage unit 52 corresponds to a storage device such as a memory. The data collection control unit 51 includes an activation management unit 3, a data collection unit 4, an error detection unit 5, and a management operation unit 7. The storage unit 52 includes a device registration database unit 2 and a data storage unit 6.

The network server 1 can be constructed using a cloud service such as AWS (Amazon Web Service) (registered trademark). Alternatively, the network server 1 may be constructed using a cloud system built on a company server. The network server 1 functions as an air-conditioning management device to collect data from a large number of air conditioners disposed in various regions in the world.

The network server 1 is connected to a plurality of edge devices 11, 12, 21 and 31 via a public communication line, and can perform bidirectional communication.

The edge device 11 is connected to a plurality of outdoor units 111A and 111B and a plurality of indoor units 112A and 112B by a transmission line, and can perform bidirectional communication. Although it is illustrated in the figure that one indoor unit is connected to one outdoor unit, a plurality of indoor units may be connected to one outdoor unit.

The edge device 11 can send data received from the network server 1 to the outdoor unit 111A and the indoor unit 112A, and can also send data received from the outdoor unit 111A and the indoor unit 112A to the network server 1. Similarly, the edge device 11 can send data received from the network server 1 to the outdoor unit 111B and the indoor unit 112B, and can also send data received from the outdoor unit 111B and the indoor unit 112B to the network server 1. Management operation commands, operation data and the like of the air conditioner may be sent or received as the data.

Each of the edge devices 12, 21 and 31 is also connected to an outdoor unit and an indoor unit of the air conditioner by transmission lines, which are not illustrated in the figure. Each of the edge devices 12, 21 and 31 can send data to or receive data from a corresponding outdoor unit and a corresponding indoor unit.

The user input unit 41 can communicate with the network server 1 via a public communication line in both directions. For example, an information terminal such as a personal computer, a tablet, or a smartphone may be used as the user input unit 41.

The user input unit 41 can communicate with the network server 1 to perform management operations and operation data collection for the air conditioner. The user input unit 41 can refer to the operation data stored in the data storage unit 6.

The device registration database unit 2 can store management information of the outdoor units 111A and 111B and the indoor units 112A and 112B which are managed by the network server 1, and information on connection between the edge device 11 and the outdoor units 111A and 111B and the indoor units 112A and 112B.

The management information stored in the device registration database unit 2 includes a model name of each of the edge device 11, the outdoor units 111A and 111B and the indoor units 112A and 112B, a time zone in which they are disposed, an operation stop state, an operation mode, an identification ID and the like thereof. The identification ID may use a generic standard such as an IP address or a proprietary standard.

Figure 2:
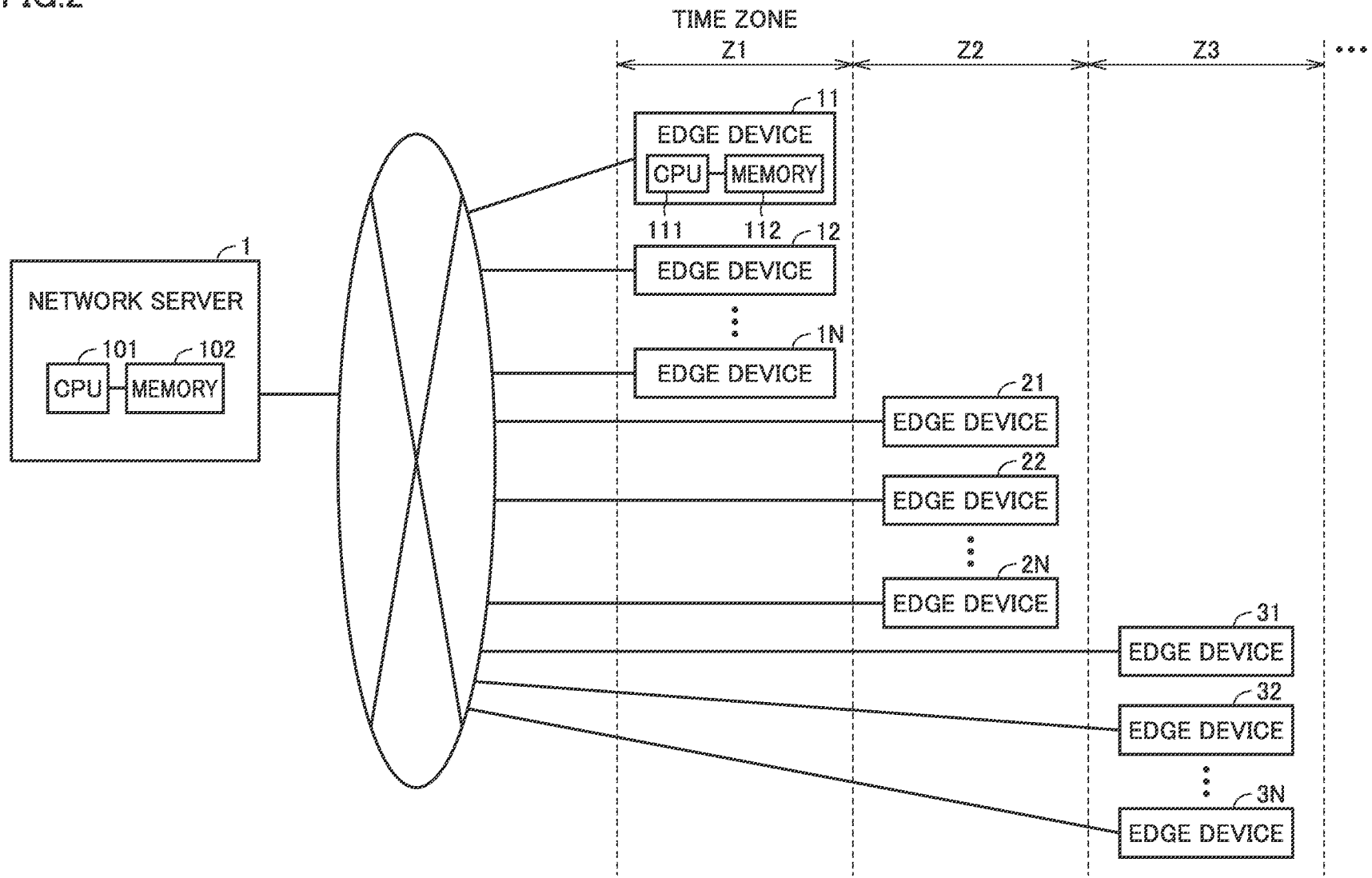
FIG. 2 is a diagram illustrating an arrangement of edge devices.

Hereinafter, the relationship between the arrangement of edge devices and time zones will be described. FIG. 2 is a diagram illustrating the arrangement of edge devices. A time zone refers to a group of regions on the earth that have adopted the same standard time. As illustrated in FIG. 2, the network server 1 is connected to a large number of edge devices 11, 12 . . . 1N, edge devices 21, 22 . . . 2N, and edge devices 31, 32 . . . 3N via a network such as the Internet.

The edge devices 11, 12 . . . 1N are disposed in a time zone Z1. The edge devices 21, 22 . . . 2N are disposed in a time zone Z2. The edge devices 31, 32 . . . 3N are disposed in a time zone Z3. For example, the time zone Z1 may be a zone to which a country such as Japan that adopts the standard time UTC+9 belongs, the time zone Z2 may be a zone to which a country such as the United Kingdom that adopts the coordinated universal time UTC as the standard time belongs, and the time zone Z3 may be a zone to which a country such as the eastern part of the United States that adopts the standard time UTC-5 belongs. The time zone may be any time zone other than the 3 time zones mentioned above. The number of time zones may be 2, 4 or more.

The network server 1 includes a CPU 101 and a memory 102. The edge device 11 includes a CPU 111 and a memory 112.

The network server 1 includes a CPU 101, a memory (including a ROM (Read Only Memory) and a RAM (Random Access Memory)) 102. The memory 102 may be any storage device such as a hard disk, a non-volatile memory, or the like.

The CPU 101 loads programs stored in the ROM into the RAM or the like and executes the programs therein. The programs stored in the ROM are programs that define processing procedures to be executed by the network server 1. The CPU 101 executes the processes as the activation management unit 3, the data collection unit 4, the error detection unit 5, and the management operation unit 7 illustrated in FIG. 1 according to these programs. The memory 102 is used as the device registration database unit 2 and the data storage unit 6.

The activation management unit 3, the data collection unit 4, the error detection unit 5, and the management operation unit 7 may be one control unit controlled by the same CPU, or may be different control units controlled by different CPUs. The network server 1 may be implemented by a plurality of servers distributed on the Internet. In addition, the device registration database unit 2 and the data storage unit 6 may be implemented by separate storage devices.

Each edge device may include a CPU 111 and a memory 112, and may perform processing in each functional block.

Referring again to FIG. 1, the functions of each block will be described. The activation management unit 3 manages the start and end of data collection performed by the data collection unit 4. The data collection unit 4 can collect the operation data of the edge devices 11, 12, 21 and 31, the operation data of the outdoor units 111A and 111B, and the operation data of the indoor units 112A and 112B, and can store the collected operation data in the data storage unit 6.

The error detection unit 5 can detect and record that the data collection unit 4 has failed to collect the operation data due to communication errors or the like.

The data storage unit 6 can store the operation data. The operation data includes data related to the control and management of air-conditioning, such as an outdoor temperature, an indoor temperature, a rotation speed of a compressor of the outdoor unit, the activation/stop information of each of the outdoor units 111A and 111B and the indoor units 112A and 112B, the operation mode, the operation time, the error information, and the amount of power consumption.

The management operation unit 7 can receive commands from the user input unit 41 and send commands to or receiving commands from the outdoor units 111A and 111B and the indoor units 112A and 112B so as to manage and control the outdoor units 111A and 111B and the indoor units 112A and 112B.

Each of the outdoor units 111A and 111B may be composed of one or more outdoor units of a general air conditioner. Each of the indoor units 112A and 112B may be composed of one or more indoor units of a general air conditioner. Instead of the indoor units 112A and 112B, an air-conditioning device such as a ventilation device may be connected to the edge device 11 or 12.

Next, the operations of the air-conditioning management system will be described. As described with reference to FIG. 2, the edge devices can be installed in a plurality of time zones, and a plurality of edge devices can be installed in one time zone.

Figure 3:
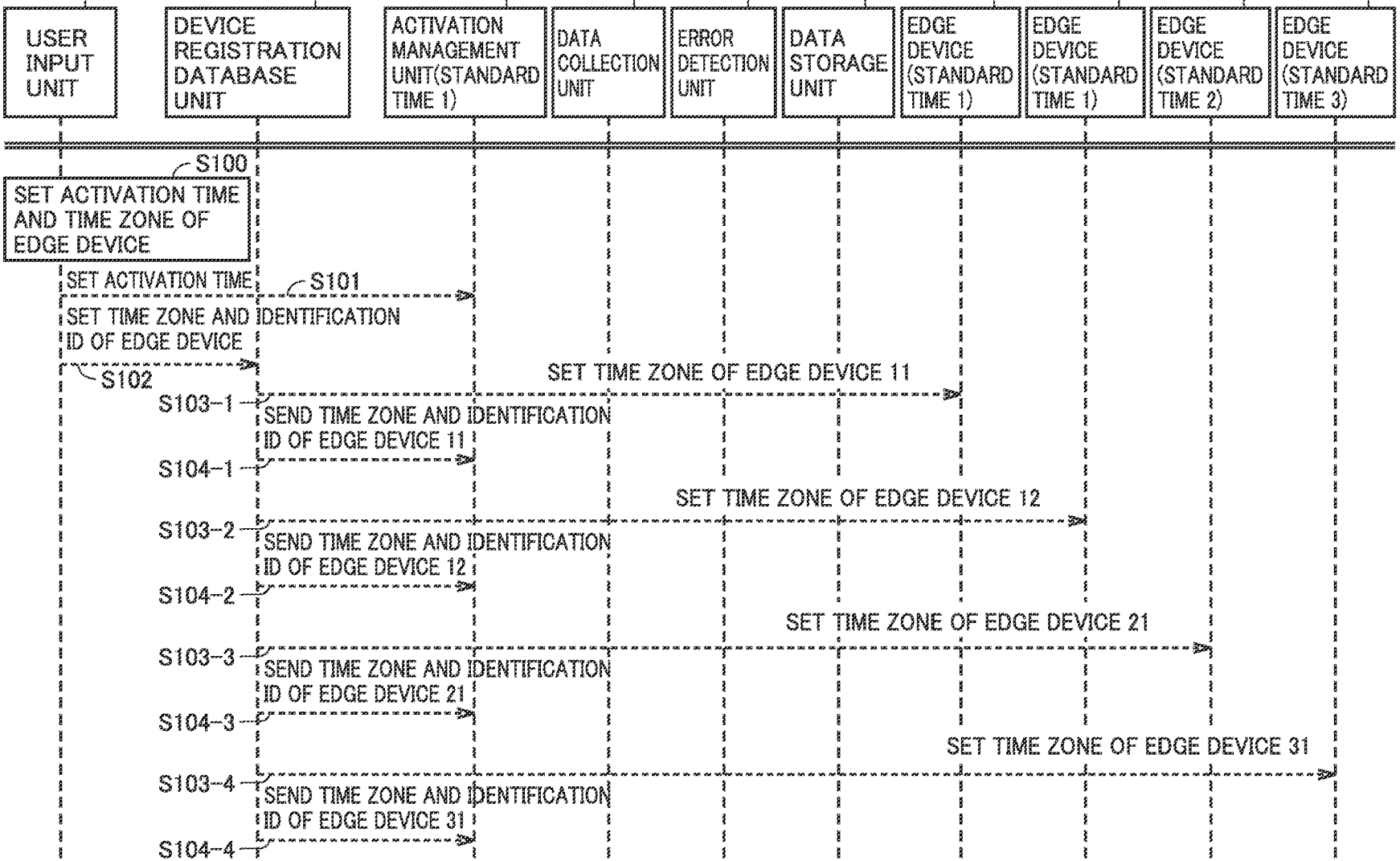
FIG. 3 is a diagram illustrating a sequence in which a network server initializes the edge devices.

FIG. 3 is a diagram illustrating a sequence in which a network server initializes edge devices. In the example of FIG. 3, the network server 1 and two edge devices 11 and 12 are disposed in a time zone (standard time 1), the edge device 21 is disposed in a time zone (standard time 2), and the edge device 31 is disposed in a time zone (standard time 3). In the following description, the term "step" is abbreviated as S.

When a user of the air conditioner uses the network server 1 to collect the operation data of the outdoor units 111A and 111B and the operation data of the indoor units 112A and 112B, the user firstly uses the user input unit 41 to set an activation time and a time zone of each edge device (S100). In response, the activation time of the activation management unit 3 received from the user input unit 41 is registered in the activation management unit 3 (S101). This time is a reference time for collecting data from each edge device.

Further, the user of the air conditioner uses the user input unit 41 to register the time zone and the identification ID of the edge device 11 in the device registration database unit 2 (S102).

The device registration database unit 2 sets the time zone of the edge device 11 (S103-1). Then, the device registration database unit 2 sends the time zone and the identification ID of the edge device 11 to the activation management unit 3 (S104-1).

Next, the device registration database unit 2 sets the time zone of the edge device 12 (S103-2). Then, the device registration database unit 2 sends the time zone and the identification ID of the edge device 12 to the activation management unit 3 (S104-2).

Next, the device registration database unit 2 sets the time zone of the edge device 21 (S103-3). Then, the device registration database unit 2 sends the time zone and the identification ID of the edge device 21 to the activation management unit 3 (S104-3).

Next, the device registration database unit 2 sets the time zone of the edge device 31 (S103-4). Then, the device registration database unit 2 sends the time zone and the identification ID of the edge device 31 to the activation management unit 3 (S104-4).

In the above description, the time zone may be different for each edge device, and one time zone may include a plurality of edge devices each having a different identification ID. The steps of S101, S102, S103-1 to S103-4, and S104-1 to S104-4 described above are executed as the initial setting when using the network server 1, and there is no need to set the initial setting at the time of using the air conditioner.

The activation management unit 3 compares a time in the standard time of the time zone where each edge device is disposed with the set activation time, and starts data collection when the two times match each other. In other words, by comparing the activation time set in the standard time 1 (S101) with the time in the standard time of each time zone, the activation time can be shifted in each time zone by the time difference between the standard time of the time zone and the standard time 1.

With reference to Table 1 below, a description will be given on how the activation time is set in the time zones Z2 and Z3 when the activation time is set in the time zone Z1. Suppose that the activation time in the standard time (UTC+9) of the time zone Z1 is set to 8:00 AM, for example.

The activation management unit 3 compares the time in the standard time of each time zone with the activation time, and when the two times match each other, the activation management unit 3 designates an edge device disposed in that time zone, and activates the data collection unit 4.

This process prevents the data collection from being performed simultaneously in each time zone. The time difference between the standard time (UTC+9) in the time zone Z1 and the standard time (UTC) in the time zone Z2 is 9 hours. Therefore, when the time in the standard time (UTC) of the time zone Z2 is 8:00 AM, it is 17:00 PM in the standard time of the time zone Z1. Therefore, the activation time in the time zone Z2 can be shifted to 17:00 PM in the standard time of the time zone Z1.

Similarly, the time difference between the standard time (UTC+9) of the time zone Z1 and the standard time (UTC-5) of the time zone Z3 is 14 hours. Therefore, when the time in the standard time (UTC-5) of the time zone Z3 is 8:00 AM, it is 22:00 PM in the standard time of the time zone Z1. Therefore, the activation time in the time zone Z3 can be shifted to 22:00 PM in the standard time of the time zone Z1.

Although some countries have introduced daylight saving time, it is preferable to use the standard time instead of the daylight saving time so as to prevent the dispersion degree of data collection from changing.

TABLE 1

| Time Zone | | Time | | | | | | | | | | | | | | | | | | | | | | | |
|---|---|---|---|---|---|---|---|---|---|---|---|---|---|---|---|---|---|---|---|---|---|---|---|---|---|
| Z1 | UTC + 9 | 8 | 9 | 10 | 11 | 12 | 13 | 14 | 15 | 16 | 17 | 18 | 19 | 20 | 21 | 22 | 23 | 0 | 1 | 2 | 3 | 4 | 5 | 6 | 7 |
| Z2 | UTC | 23 | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 |
| Z3 | UTC − 5 | 18 | 19 | 20 | 21 | 22 | 23 | 0 | 1 | 2 | 3 | 4 | 5 | 6 | 7 | 8 | 9 | 10 | 11 | 12 | 13 | 14 | 15 | 16 | 17 |

Figure 4:
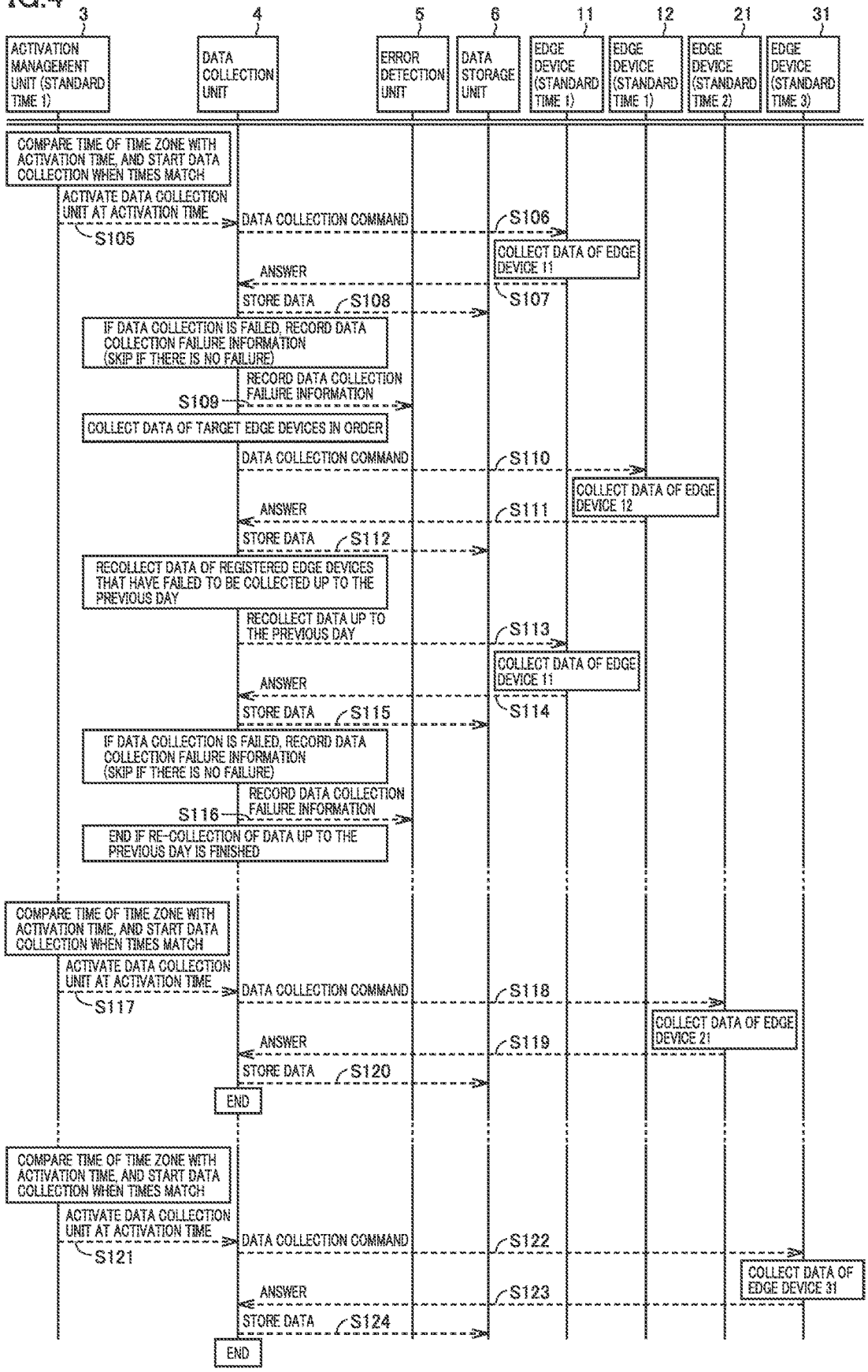
FIG. 4 is a diagram illustrating a procedure in which a data collection unit on a network server collects operation data of an air conditioner from an edge device.

FIG. 4 is a diagram illustrating a procedure in which the data collection unit 4 on the network server 1 collects the operation data of the air conditioner from the edge devices. The data collection process illustrated in FIG. 4 is performed periodically. For example, it is assumed that the operation data is collected once per day for each edge device.

First, the activation management unit 3 compares the time of each time zone with the activation time, and when the standard time 1 and the activation time match each other, the activation management unit 3 designates the identification ID of the edge device 11 disposed in that time zone, and activates the data collection unit 4 (S105).

Since the activation management unit 3 activates the data collection unit 4 at the time in the time zone of each edge device, even the operation data is being collected when a large number of edge devices are connected to the network server 1, the operation data can be collected separately from the edge devices in each time zone. Therefore, as compared with the case where the operation data is collected simultaneously for all edge devices, it is possible to reduce the amount of processing resources of the network server 1.

The data collection unit 4 sends an operation data collection command to the edge device 11 having the identification ID designated by the activation management unit 3 (S106).

Figure 5:
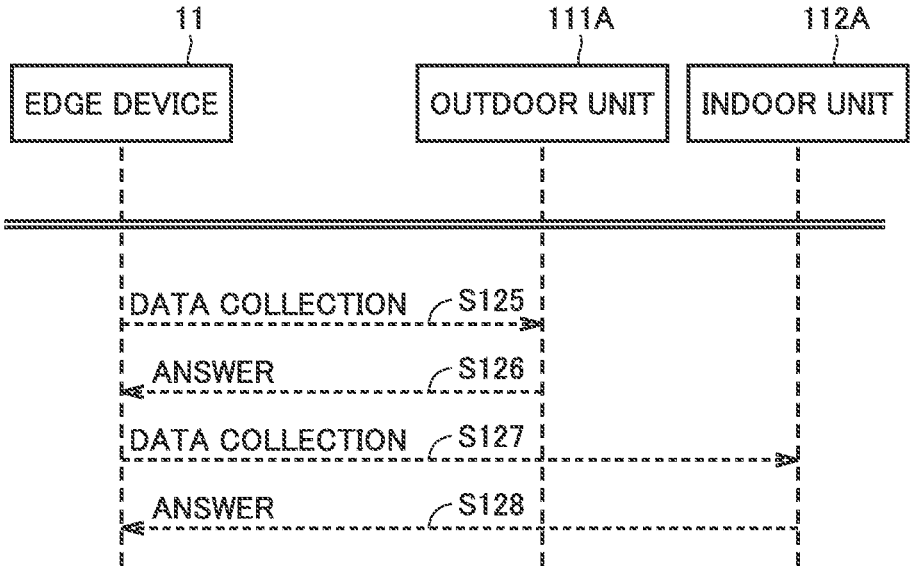
FIG. 5 is a sequence diagram illustrating a process in which an edge device collects operation data from an outdoor unit and an indoor unit.

FIG. 5 is a sequence diagram illustrating a process in which the edge device collects data from the outdoor unit and the indoor unit. The edge device 11 sends a data collection command to the outdoor unit 111A (S125), and in response, the outdoor unit 111A sends the operation data to the edge device 11 (S126).

Then, the edge device 11 sends a data collection command to the indoor unit 112A (S127), and in response, the indoor unit 112A sends the operation data to the edge device 11 (S128).

In the case of an air conditioner in which a plurality of indoor units are connected to the outdoor unit 111A, the data collection process is further performed in order between each indoor unit 112A, 113A . . . and the edge device 11.

Although not shown, in the case of an air conditioner in which a plurality of outdoor units are connected to the edge device 11 as illustrated in FIG. 1, the data collection is performed between each outdoor unit and the edge device 12 in the same way as the edge device 11.

Upon receiving a data collection command from the data collection unit 4, the edge device 11 collects the operation data from the outdoor units 111A and 111B and the indoor units 112A and 112B. Note that the edge device 11 may be configured to collect the operation data constantly so that the edge device 11 may immediately respond to the data collection unit 4 upon receiving a data collection command from the data collection unit 4.

Referring again to FIG. 4 to continue the description. In response to the data collection command, the edge device 11 sends the operation data to the data collection unit 4 (S107). The data collection unit 4 stores the received operation data in the data storage unit 6 (S108).

When the operation data cannot be successfully collected due to, for example, an error in the communication between the network server 1 and the edge device 11, or between the edge device 11 and the outdoor units 111A and 111B or the indoor units 112A and 112B, the data collection unit 4 stores data collection failure information in the error detection unit 5 (S109).

The data collection failure information may include an identification ID of an outdoor unit or an indoor unit from which the operation data has failed to be collected, a date and time at which the operation data has failed to be collected, and a type of the operation data that has failed to be collected.

When there are a plurality of edge devices having identification IDs to be subjected to the operation data collection within the same time zone, the data collection unit 4 sequentially collects the operation data from each of the plurality of edge devices and stores the operation data in the data storage unit 6. The time interval for the data collection unit 4 to start collecting the operation data can be determined by waiting until the collection of operation data from one edge device is completed, or by sequentially performing the operation data collection at a regular interval after the collection of operation data from one edge device has started. FIG. 4 illustrates an example in which the operation data is sequentially collected from the edge device 11 and the edge device 12 (S110, S111, S112).

The edge device may retain the operation data for five days, for example, and the operation data that could not be retrieved may be sent in the next data transmission.

Upon completing the collection of operation data for the current day, the data collection unit 4 refers to the data collection failure information from the error detection unit 5, and recollects the operation data retained by the edge device which has failed to be collected on the previous day (S113). For example, if the edge device 11 has failed to collect the operation data on the previous day, the data collection unit 4 requests the edge device 11 to recollect the operation data for the previous day from the outdoor unit and the indoor unit, and in response, the edge device 11 recollects the operation data. Then, the edge device 11 sends the collected operation data to the data collection unit 4 (S114). The data collection unit 4 stores the received operation data in the data storage unit 6 (S115).

If the operation data has failed to be collected in the operation data recollection again, the data collection unit 4 updates the data collection failure information in the error detection unit 5 (S116). This allows the data collection to be performed again even if there is a further failure in the operation data recollection. If there is no data collection failure, the update of the data collection failure information is skipped.

Thus, the collection of operation data from the edge device disposed in the time zone of the standard time 1 is completed.

The activation management unit 3 continues to monitor whether or not the activation time and the time of each time zone match each other.

The activation management unit 3 compares the time in the time zone of the standard time 2 with the activation time, and when the two times match each other, the activation management unit 3 designates the identification ID of the edge device 21 disposed in the time zone, and activates the data collection unit 4 (S117). The data collection unit 4 sends an operation data collection command to the edge device 21 having the identification ID designated by the activation management unit 3 (S118). The edge device 21 sends the operation data to the data collection unit 4 (S119). The data collection unit 4 stores the operation data in the data storage unit 6 (S120).

Thus, the collection of operation data from the edge device disposed in the time zone of the standard time 2 is completed.

Similarly, the activation management unit 3 compares the time in the time zone of the standard time 3 with the activation time, and when the two times match each other, the activation management unit 3 designates the identification ID of the edge device 31 disposed in the time zone, and activates the data collection unit 4 (S121). The data collection unit 4 sends an operation data collection command to the edge device 31 having the identification ID designated by the activation management unit 3 (S122). The edge device 31 sends the operation data to the data collection unit 4 (S123). The data collection unit 4 stores the operation data in the data storage unit 6 (S124).

Thus, the collection of operation data from the edge device disposed in the time zone of the standard time 3 is completed. In this way, it is possible to collect the operation data separately for each time zone without the need for a user to set a detailed schedule.

In FIG. 4, it is described that a plurality of edge devices 11 and 12 are disposed in the same time zone of the standard time 1. However, as described hereinafter, since many countries in which edge devices are disposed may be in the same time zone, or a large number of edge devices may be disposed in the same country, they will be divided by country or region.

The cloud server is disposed in country A, and the edge devices are disposed respectively in countries B and C which are located in the same time zone. The country B includes a region D1 and a region D2, and the country C includes a region D3 and a region D4.

In such a case, data can be collected as follows.

The cloud server is registered in advance with priority data for countries and regions. The cloud server collects data according to the registered priority data.

For example, the priority data contains the order of priority of data collection for each country and region, such as country B (D1>D2), country C (D3>D4), and so on.

According to the priority data, the cloud server collects data in the order of region D1, region D2, region D3, and region D4.

In addition to the country and region, information such as the name of a user of a service or the business type of a user (such as communication industry, distribution industry, government office or the like) can be used as the priority data.

Second Embodiment

Figure 6:
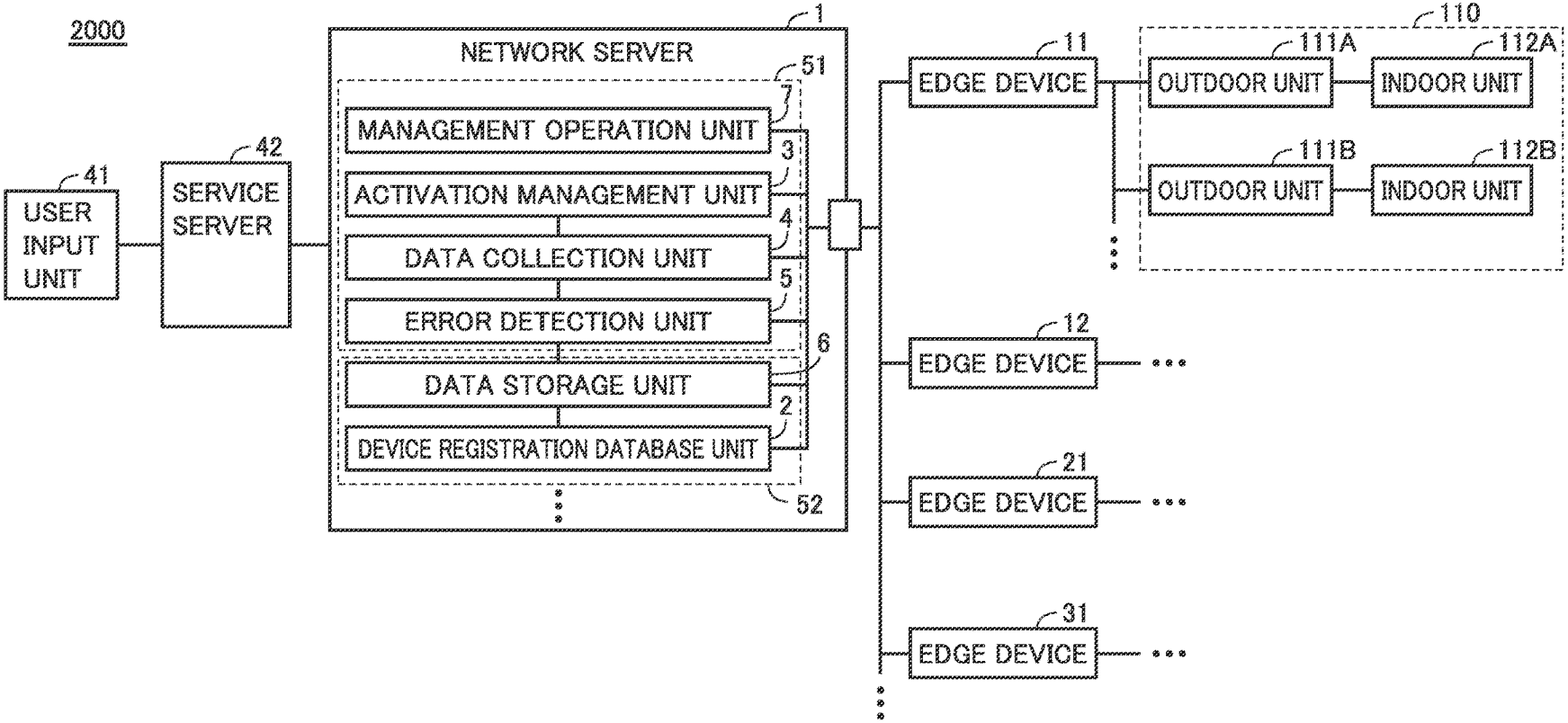
FIG. 6 is a diagram illustrating a configuration of an air-conditioning management system according to a modification.

FIG. 6 is a diagram illustrating a configuration of an air-conditioning management system according to a modification. The air-conditioning management system 2000 according to the modification illustrated in FIG. 6 includes a service server 42 disposed between the network server 1 and the user input unit 41 in the configuration of the air-conditioning management system 1000 illustrated in FIG. 1. The service server 42 can be used to complement functions not provided by the network server 1. For example, the service server 42 provides, to the user input unit 41, a GUI (Graphical User Interface) that processes and displays the operation data obtained from the network server 1 so that the air-conditioning operation can be realized more simply.

Even in such a modification, the same control as in the first embodiment can be applied to avoid the concentration of data collection time.

SUMMARY

Finally, the present embodiment will be summarized with reference to the drawings.

The present disclosure relates to a network server 1 that functions as an air-conditioning management apparatus configured to collect operation data of an air conditioner 110 via a public communication line and a plurality of edge devices 11, 12, 21 and 31. As illustrated in FIG. 2, the plurality of edge devices 11, 12, 21 and 31 are distributed in a plurality of time zones Z1, Z2, and Z3. The network server 1 includes a storage unit 52 that stores the operation data, and a data collection control unit 51 connected to a plurality of edge devices 11, 12, 21 and 31 via the public communication line and configured to collect the operation data and store the collected operation data in the storage unit 52. The data collection control unit 51 determines a time to collect the operation data from each of the plurality of edge devices 11, 12, 21 and 31 based on a standard time of the time zones Z1, Z2 and Z3 where each of the plurality of edge devices 11, 12, 21 and 31 is disposed.

It is acceptable that the storage unit 52 is configured to store first information indicating a relationship between a standard time of a time zone corresponding to each of the plurality of edge devices 11, 12, 21 and 31 and an edge device corresponding to the time zone. As described by way of example in Table 1, the data collection control unit 51, based on the time difference between a standard time (UTC+9, UTC, UTC-5) of each of the time zones Z1, Z2 and Z3 corresponding to each of the plurality of edge devices indicated by the first information and a standard times (UTC+9) of a time zone in which the data collection control unit 51 is disposed, determines a second time (8:00 AM, 11:00 AM, 22:00 PM) to collect the operation data from each of the plurality of edge devices 11, 12, 21 and 31 from a first time (8:00 AM) that serves as a reference time to collect the operation data.

It is also acceptable that the storage unit 52 is configured to store an identification ID which is assigned to each of the plurality of edge devices 11, 12, 21 and 31 so as to identify each of the plurality of edge devices 11, 12, 21 and 31. As described in S106 to S111 of FIG. 4, the data collection control unit 51 classifies as a group the edge devices 11 and 12 which belong to the plurality of edge devices 11, 12, 21 and 31 and are disposed in the same time zone, shifts the second time according to the identification ID, and determines a third time to collect the operation data from each of the edge devices 11 and 12 in the group. It is acceptable that each of the plurality of edge devices 11, 12, 21 and 31 is configured to retain the operation data for two or more transmissions (for example, for 5 days). As described in S109 and S113 of FIG. 4, the data collection control unit 51 stores in the storage unit second information indicating an identification ID and a corresponding time zone of an edge device that failed to collect the operation data, and recollects the operation data that failed to be collected based on the second information at the next data collection.

In another aspect, the present disclosure relates to an air-conditioning management system 1000 including a plurality of edge devices 11, 12, 21 and 31 and the network server 1 described above.

It should be understood that the embodiments disclosed herein are illustrative and non-restrictive in all respects. The scope of the present invention is defined by the terms of the claims rather than the description of the embodiments above, and is intended to include any modifications within the scope and meaning equivalent to the terms of the claims.

The invention claimed is:

1. An air-conditioning management apparatus configured to collect operation data of an air conditioner via a public communication line and a plurality of edge devices, the plurality of edge devices being distributed in a plurality of time zones, the air-conditioning management apparatus including:

a storage unit to store the operation data; and a data collection control unit connected to the plurality of edge devices via the public communication line, and configured to collect the operation data and store the collected operation data in the storage unit, the data collection control unit determining a time to collect the operation data from each of the plurality of edge devices based on a standard time of a time zone where each of the plurality of edge devices is disposed, wherein the storage unit is configured to store first information indicating a relationship between a standard time of a time zone corresponding to each of the plurality of edge devices and an edge device corresponding to the time zone, and the data collection control unit, based on a time difference between a standard time of a time zone corresponding to each of the plurality of edge devices indicated by the first information and a standard time of a time zone where the data collection control unit is disposed, determines a second time to collect the operation data from each of the plurality of edge devices from a first time that serves as a reference time to collect the operation data.

2. The air-conditioning management apparatus according to claim 1, wherein the storage unit is configured to store an identification ID which is assigned to each of the plurality of edge devices so as to identify each of the plurality of edge devices, the data collection control unit classifies as a group the edge devices which belong to the plurality of edge devices and are disposed in the same time zone, shifts the second time according to the identification ID, and determines a third time to collect the operation data from each of the edge devices in the group.

3. The air-conditioning management apparatus according to claim 1, wherein each of the plurality of edge devices is configured to retain the operation data for two or more transmissions, the data collection control unit stores in the storage unit second information indicating an identification ID and a corresponding time zone of an edge device that failed to collect the operation data, and recollects the operation data that failed to be collected based on the second information at the next data collection.

* * * * *